US008210006B2

(12) United States Patent
Huang et al.

(10) Patent No.: US 8,210,006 B2
(45) Date of Patent: Jul. 3, 2012

(54) PICK RESISTANT HANDCUFFS HAVING CENTRAL RAIL

(75) Inventors: Wen-Sheng Huang, Ta-Li (TW); Charles E. Thompson, Riverside, IL (US)

(73) Assignee: CSI-Penn Arms, LLC, Jamestown, PA (US)

( * ) Notice: Subject to any disclaimer, the term of this patent is extended or adjusted under 35 U.S.C. 154(b) by 0 days.

(21) Appl. No.: 12/836,537

(22) Filed: Jul. 14, 2010

(65) Prior Publication Data

US 2011/0232338 A1 Sep. 29, 2011

(30) Foreign Application Priority Data

Jul. 15, 2009 (TW) ..... 98212921 U

(51) Int. Cl.
*E05B 75/00* (2006.01)

(52) U.S. Cl. ..... 70/16

(58) Field of Classification Search ..... 70/15–17, 70/419; 119/816, 819; 128/878, 879
See application file for complete search history.

(56) References Cited

U.S. PATENT DOCUMENTS

| | | | | |
|---|---|---|---|---|
| 1,775,727 | A * | 9/1930 | Latou | 70/16 |
| 1,845,511 | A * | 2/1932 | Neal | 70/16 |
| 1,900,242 | A * | 3/1933 | Latou | 70/16 |
| 2,390,885 | A * | 12/1945 | Kelley | 70/16 |
| 5,193,254 | A * | 3/1993 | Geisinger | 24/484 |
| 6,574,998 | B2 * | 6/2003 | Kwon | 70/16 |
| 6,851,284 | B2 * | 2/2005 | Kim et al. | 70/16 |
| 6,997,020 | B2 * | 2/2006 | Kozak et al. | 70/16 |
| 7,424,811 | B2 * | 9/2008 | Ham et al. | 70/16 |

* cited by examiner

*Primary Examiner* — Lloyd Gall
(74) *Attorney, Agent, or Firm* — Economou IP Law; Vangelis Economou

(57) ABSTRACT

Pick-resistant handcuffs having two fixed, arc-shaped hooks and one pivotable, arc-shaped hook. The two fixed ring hooks engage each other to form an accommodation chamber for receiving the pivoting hook penetrating into an open side of the accommodation chamber. Central channels are cut in the teeth outer periphery and accommodate a stop projecting part between the lateral edges of the teeth that inhibits unlocking the stop members of the ratchet attached to the two fixed hooks. Elastic members biased toward the teeth are disposed on either side of the stop projecting part act independently to provide ratchet stops to each tooth edge, and the stop projecting portion blocks insertion of a pick and unlock both of the two ratchets simultaneously.

18 Claims, 7 Drawing Sheets

PICK RESISTANT HANDCUFFS HAVING CENTRAL RAIL

CROSS REFERENCE TO RELATED APPLICATIONS

This is an application under the Paris Convention corresponding to and relying on priority of Taiwanese Application Case No. 098212921, filed in the Taiwanese Patent Office on Jul. 15, 2009 and published on Mar. 21, 2010 under Taiwanese Patent No. M376625.

BACKGROUND ART

1. Technical Field

The present design pertains to a structural modification to handcuffs, especially, a handcuff structure that has a good locking effect and can effectively prevent unlocking by improper means or articles other than the key.

2. Prior art

As shown in FIG. 1, the conventional handcuff structure has a chain D (or a steel cord or other similar connection member) that connects two handcuff main bodies C (it is also possible to connect a single handcuff main body C at a fixed position). Each handcuff body A is comprised of two fixed, arc-shaped hooks 1, 10 and a movable ring hook 20 that rotate relative to each other about a pivot 100. The two fixed ring hooks 1, 10 are engaged with each other at the other end. There is an accommodation chamber 11. A horizontal side hole 13 connected to the outside is provided on said accommodation chamber 11 at the end adjacent to fixed ring hooks 1, 10. A connected key recessed part 12 is provided at the other end of said accommodation chamber 11. Said key recessed part 12 can be connected to the outside via a key hole 121. A plurality of projecting teeth 21 are provided on the outer periphery at the other free end of said movable ring hook 20. One end of a locking member 3 is pivoted in accommodation chamber 11 on the side away from key recessed part 12. The other end of said locking member 3 has a side projecting part 31 that can stick into said key recessed part 12. A projecting part 32 that extends upwards is provided on the side of said side projecting part 31. A plurality of lock projecting teeth 33 are provided at the other (free) end of locking member 3 corresponding to the open side of accommodation chamber 11. A stop block 5 is provided on the top side in accommodation chamber 11. A side edge 51 extending toward key recessed part 12 is provided at its one end. An abutting part 52 extending downwards is provided on the side of said side edge 51. A plurality of alignment recessed parts 53 are provided on the side of said abutting part 52. A V-shaped elastic member 4 is provided between locking member 3 and stop block 5. One side of the elastic member is abutted against the top edge of said locking member 3, while the other side has at least one bent projecting part 41 to fit in the alignment recessed part 53 of stop block 5. Also, the elastic abutting of said elastic member 4 can make locking member 3 maintain the outward elasticity of its lock projecting teeth 33 from accommodation chamber 11. During use, when the free end of said movable ring hook 20 sticks into accommodation chamber 11, its projecting teeth 21 can be engaged with the lock projecting teeth 33 of locking member 3 to achieve locking. At that time, the arms and legs (usually, wrists) of a person can fit in the spaces defined between fixed ring hooks 1, 10 and movable ring hook 20 to restrain the person's movement. As shown in FIG. 2, if a thin push rod penetrates through side hole 13 from outside, it can push stop block 5 and make it slide. The abutting part 52 of stop block 5 can move to the right to the position where it abuts against the projecting part 32 of locking member 3 to achieve a reinforced locking state of the locking member 3 that is more difficult to unlock by illegal means. If it is necessary to unlock handcuff main body C under normal circumstances, a key can be inserted into key recessed part 12 from key hole 121. When the key is first turned counterclockwise, the projecting abutting part at the end of the key pushes stop block 5 to move in the opposite direction (to the left) to release the abutting state of its abutting part 52 against projecting part 32 on the top. Then, the projecting abutting part of the key is turned clockwise so that the projecting abutting part can push the side projecting part 31 of locking member 3 upwards. As a result, locking member 3 pivots and lock projecting teeth 33 are disengaged from the projecting teeth 21 of movable ring hook 20 (and pressing elastic member 4 at the same time) so that movable ring hook 20 can pivot in the opposite direction, and its free end is disengaged in accommodation chamber 11 to release the aforementioned locking state. However, since the aforementioned locking structure and theory are relatively simple and the shape of the key has no complicated variations, anybody can unlock the handcuffs with a thin wire having a hook instead of the key. Therefore, the locking effect is extremely poor in practical application, which always causes troubles to the user.

Therefore, the structure shown in FIG. 3 is disclosed. The handcuff main body B is based on the structure shown in FIG. 1. It has the same fixed ring hooks 1, 10, movable ring hook 20, and other basic structures. The only difference is that locking member 3, elastic element 4, and stop block 5 have locking member 30, elastic member 40, and stop block 50 having exactly the same structures provided on their side, respectively. Two groups of independent locking mechanisms are formed by said locking member 3, elastic element 4, and stop block 5 as well as locking member 30, elastic member 40, and stop block 50 to lock said movable hook ring 20. When a thin wire having a hook is inserted and turned, it can only unlock one group of the locking mechanism, that is, locking member 3, and stop block 5 (or locking member 30, and stop block 50), while the locking member 30, and stop block 50 (or locking member 3, and stop block 5) are still in the locking state. In this way, it is possible to effectively prevent the handcuffs from being unlocked by any non-key, hook-shaped article. However, relatively big spaces 14, 141 (as shown in FIG. 4) are usually left between said movable ring hook 20 and the front, rear sides of accommodation chamber 11 so that the projecting teeth 21 of movable ring hook 20 can easily penetrate into (or pass through) the open side of accommodation chamber 11 (to engage with the lock projecting teeth 33 of locking member 3). Therefore, with adequate force, anybody can stick a narrow body 7 into spaces 14, 141. As a result, said narrow body is inserted between the projecting teeth 21 of movable ring hook 20 and the lock projecting teeth 33 of locking member 3 and disengage them from each other to unlock the handcuffs. This is a serious problem in application.

In order to solve the aforementioned problems of the conventional handcuffs, the present designer has conducted extensive research. The present design was reached as a result of this research.

SUMMARY OF THE INVENTION

The main objective of the present design is to provide a structural modification to handcuffs, which can prevent a non-key tool from being inserted into the key hole to unlock the cuffs and can prevent a narrow body or other improper means from being inserted into the space between the movable ring hook and the accommodation chamber to unlock the cuffs. In this way, it is possible to increase the difficulty of illegal unlocking and improve the locking effect.

In order to realize the aforementioned objective and effect, the technical means adopted by the present design includes: two fixed, arc-shaped hooks 1,10, the two fixed ring hooks 1,10 are engaged with each other at the other end to form an accommodation chamber 11 that opens towards an inside of each hook, and a pair of key holes 121 connecting to the outside are provided on one side of the accommodation chamber 11; a movable, arc-shaped hook 20 with one end pivoted between the two fixed ring hooks 1, 10 at the end away from the accommodation chamber 11, a plurality of projecting teeth and a middle channel 22 that penetrates through each projecting tooth are provided on the outer periphery at the other end of the movable ring hook, and the plurality of projecting teeth can penetrate into the accommodation chamber as the movable ring hook 20 pivots; a plurality of identical locking members 3, 30 provided in parallel with each other, one end of each locking member is jointly pivoted inside the accommodation chamber facing one side of the fixed ring hooks, while a side projecting part 31, 301 that can extend to the part corresponding to the key hole 121 is provided at the other end, and a plurality of lock projecting teeth 33, 303 are provided on the side of each locking member 3, 30; at least one spacer 6 provided between every two locking members 3, 30 with one end jointly pivoted with the locking members 3, 30 in the accommodation chamber 11, a stop projecting part 63 corresponding to the lock projecting teeth 33, 303 of the locking member 3, 30 is provided at the other end of the spacer 6; at least one elastic member provided between each locking member 3, 30 on the side opposite to the side having the lock projecting teeth 33, 303 and the inner side of the accommodation chamber 11, the elastic member can abut against the locking member 3, 30 so that the lock projecting teeth 33, 303 thereof can keep an outward elasticity in order to fit between the plurality of projecting 21 teeth of the movable ring hook 20, and the spacer 6 can be inserted into the middle channel 22.

The detailed structure, application theory, effects and functions of the present design can be fully understood based on the following explanation with reference to the attached figures.

BRIEF DESCRIPTION OF THE DRAWING FIGURES

DETAILED DESCRIPTION OF THE PREFERRED EMBODIMENTS

Figure 1:
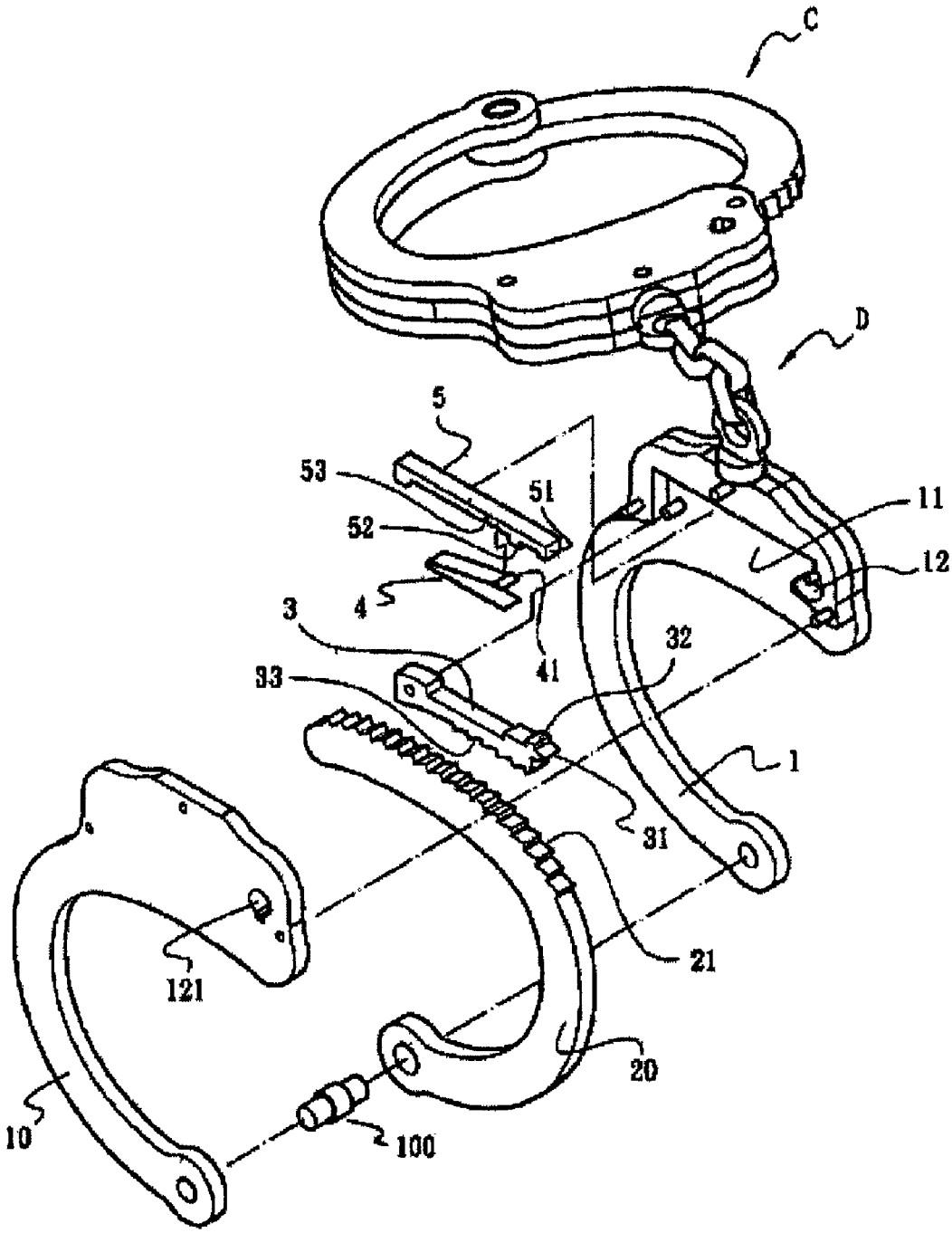
Figure 1 PRIOR ART
FIG. 1 is the structural exploded diagram of one type of conventional handcuffs.
Figure 2:
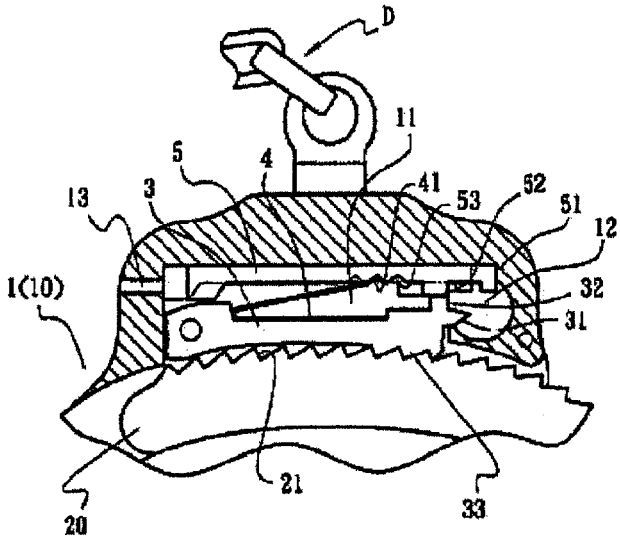
Figure 2 PRIOR ART
FIG. 2 is a cross-sectional view illustrating the reinforced locking state of the handcuffs shown in FIG. 1.
Figure 3:
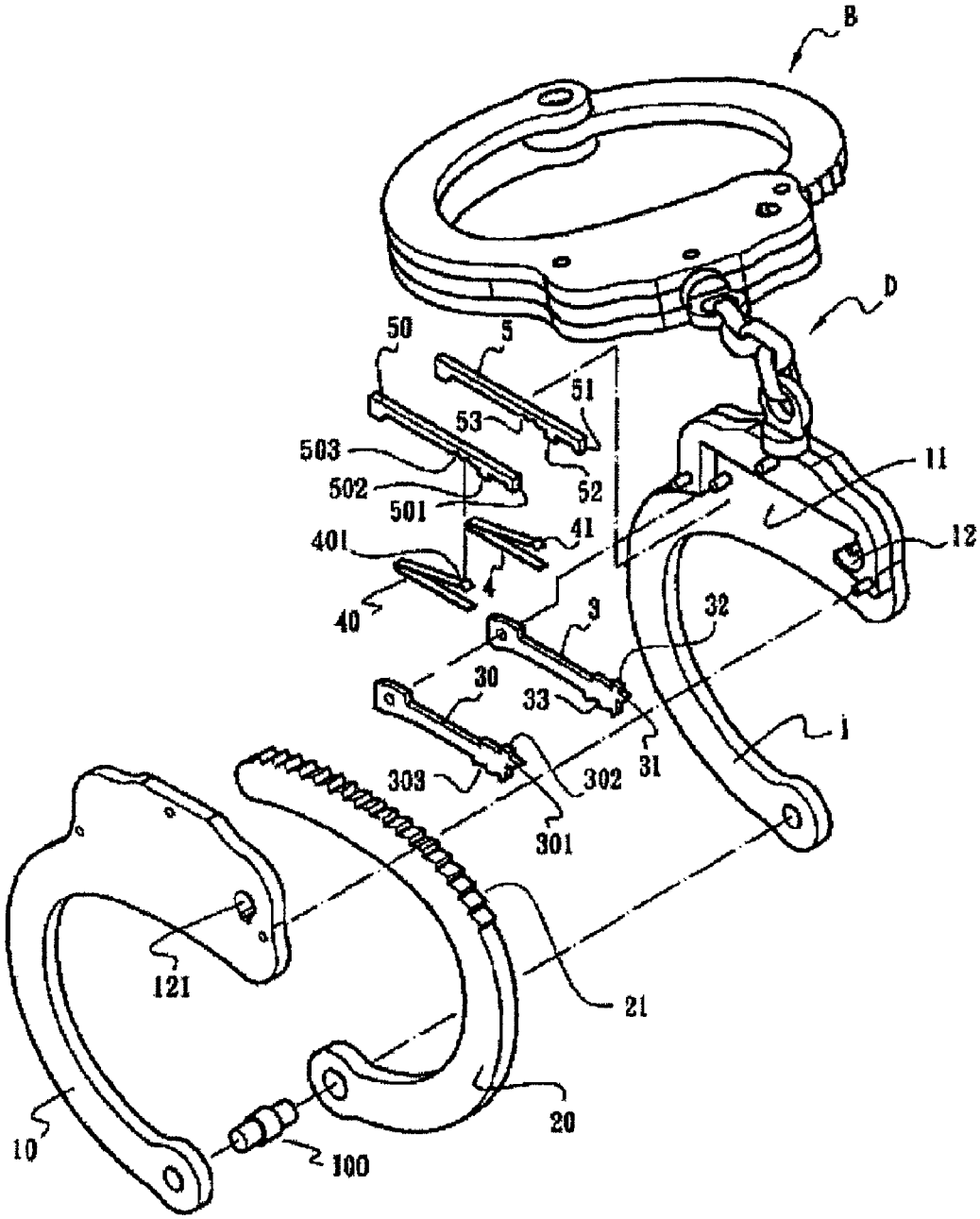
Figure 3 PRIOR ART
FIG. 3 is the structural exploded diagram of another type of conventional handcuffs.
Figure 4:
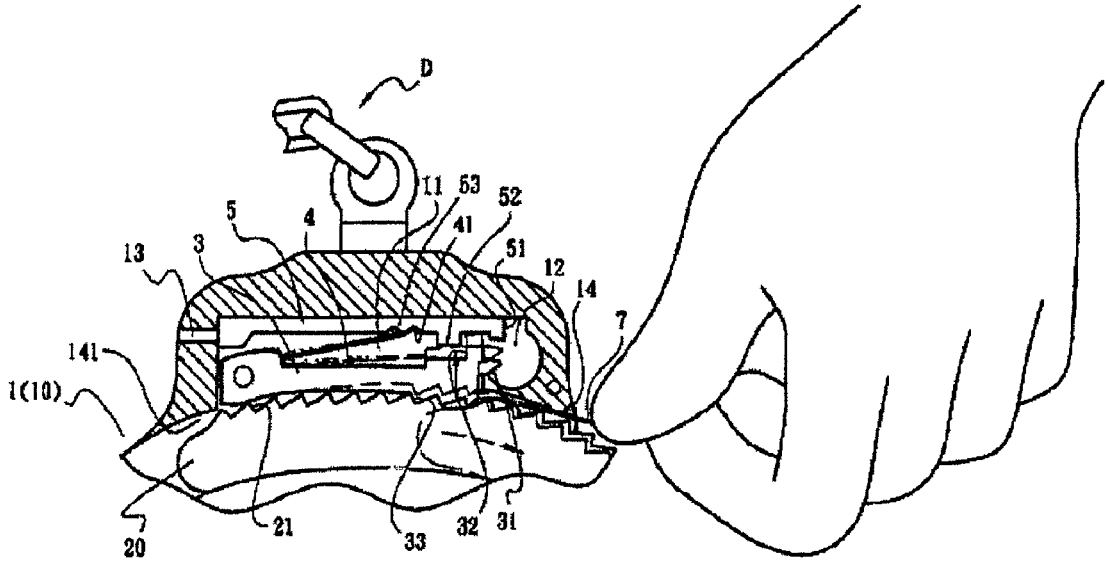
Figure 4 PRIOR ART
FIG. 4 is a diagram illustrating the operation of unlocking the handcuffs shown in FIG. 3 with use of an improper means.
Figure 5:
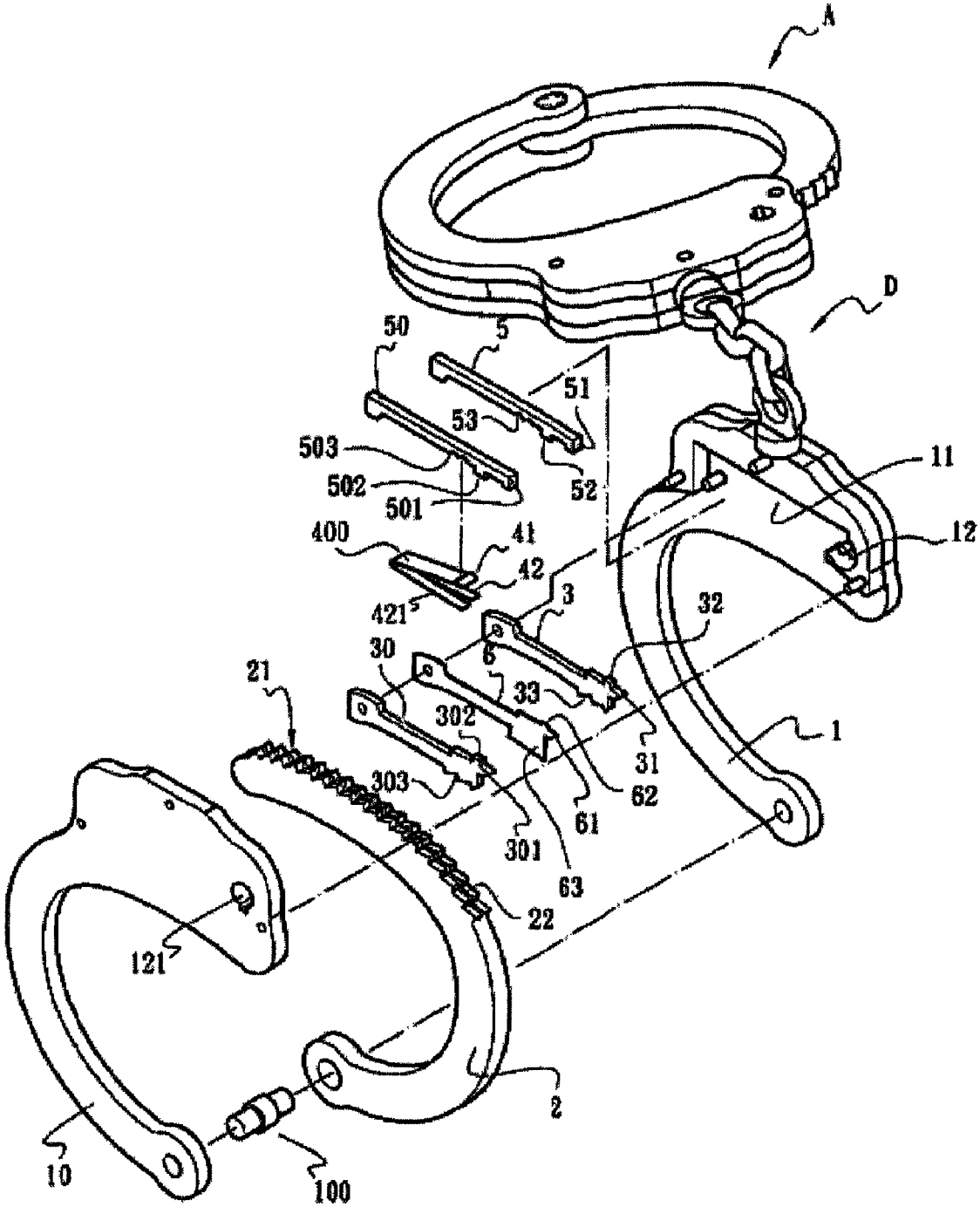
FIG. 5 is the structural exploded diagram of the present invention.

As shown in FIG. 5, it is clear that the structure of the handcuff main body A of the present design mainly includes: two fixed, arc-shaped hooks 1, 10 and one movable, arc-shaped hook 2, at least two identical locking members 3, 30, at least one elastic member 400, at least two stop blocks 5, 50, and at least one spacer 6. One end of said movable ring hook 2 is pivoted between one end of two fixed ring hooks 1, 10 via a pivot 100. The two fixed ring hooks 1, 10 are engaged with each other at the other end. Also, there is an accommodation chamber 11 that is open at the inside. A horizontal side hole 13 that connects to the outside is provided at one end of accommodation chamber 11 adjacent to fixed ring hooks 1, 10. A connected key recessed part 12 is provided on the side of the other end of accommodation chamber 11. Said key recessed part 12 can be connected to the outside through a key hole 121. A plurality of projecting teeth 21 are provided on the outer periphery at the other free end of movable ring hook 2. There is a middle channel 22 that penetrates through each projecting tooth 21 in the longitudinal direction. Locking members 3, 30 are jointly pivoted at one end in accommodation chamber 11 on the side away from key recessed part 12. Projecting parts 31, 301 that can stick into key recessed part 12 are provided at the other end of locking members 3, 30, respectively. A plurality of lock projecting teeth 33, 303 are provided on the side of said projecting parts 31, 301 corresponding to the open side of accommodation chamber 11. Projecting parts 32, 302 that extend upwards are provided on the opposite side of said lock projecting teeth 33, 303, respectively. Spacer 6 is provided between said two locking members 3, 30 with one end jointly pivoted along with locking members 3, 30 in accommodation chamber 11. Side projecting part 61, top projecting part 62, and stop projecting part 63 are provided at the other end of spacer 6 correspond to the side projecting part 31, top projecting part 32, and lock projecting teeth 33 of locking member 3, respectively. Stop blocks 5, 50 are provided in accommodation chamber 11 with one end jointly set on the side corresponding to side hole 13. Side edges 51, 501 that extend toward key recessed part 12 are provided at the other end, respectively. Abutting parts 52, 502 are provided beside side edges 51, 501 corresponding to the open side of accommodation chamber 11, respectively. A plurality of alignment recessed parts 53, 503 are provided beside said abutting parts 52, 502. Elastic member 400 has a V shape and is provided between locking members 3, 30 and stop blocks 5, 50. Two branched edge sides 42, 421 are provided on its one side to abut against the top side edges of the two locking members 3, 30, respectively. At least one bent projecting part 41 is provided on the other side to fit in the alignment recessed parts 53, 503 of stop blocks 5, 50. With the aid of the elastic support by V-shaped elastic member 400, said two locking members 3, 30 can maintain its outward elasticity from accommodation chamber 11 through their lock projecting teeth 33, 303.

Figure 6:
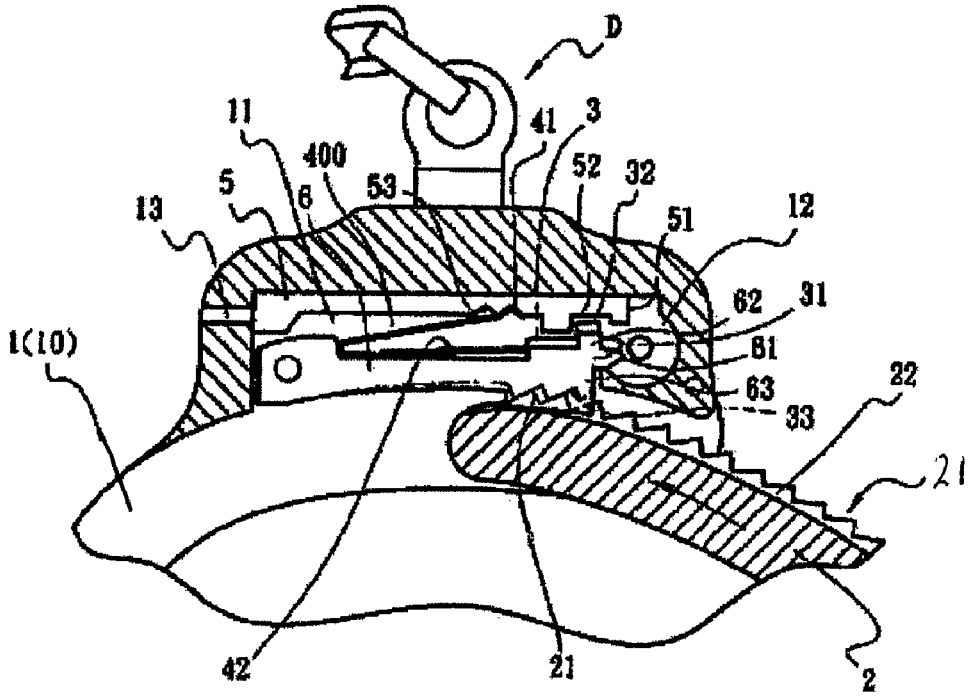
FIG. 6 is a diagram illustrating the engagement state between the projecting teeth and the lock projecting teeth in the locking state of the present invention.
Figure 7:
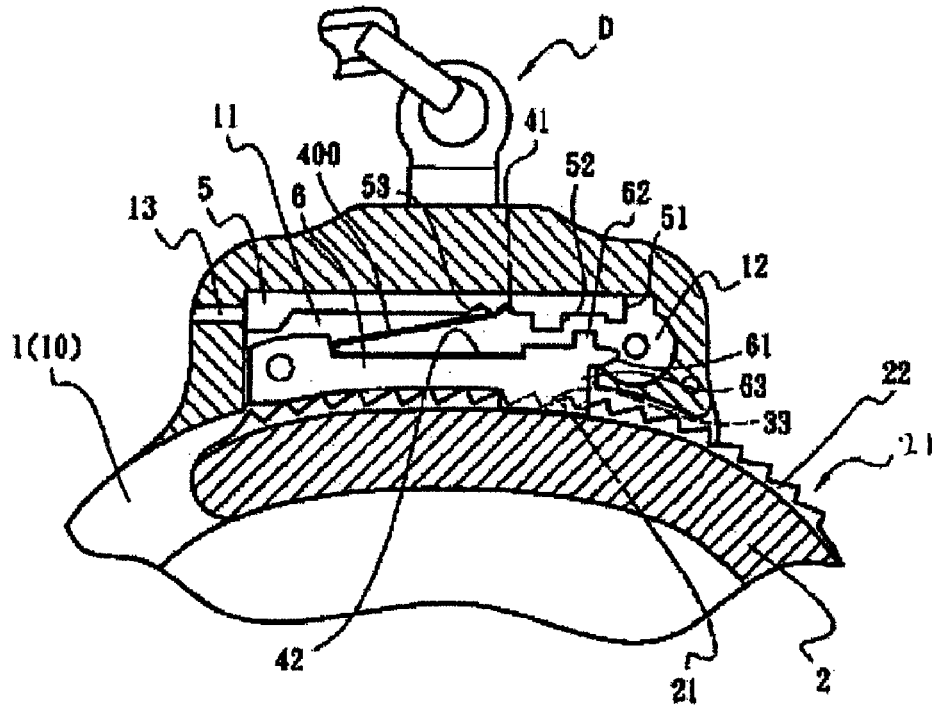
FIG. 7 is a diagram illustrating the state when the spacer is inserted into the middle channel in the locking state of the present invention.
Figure 8:
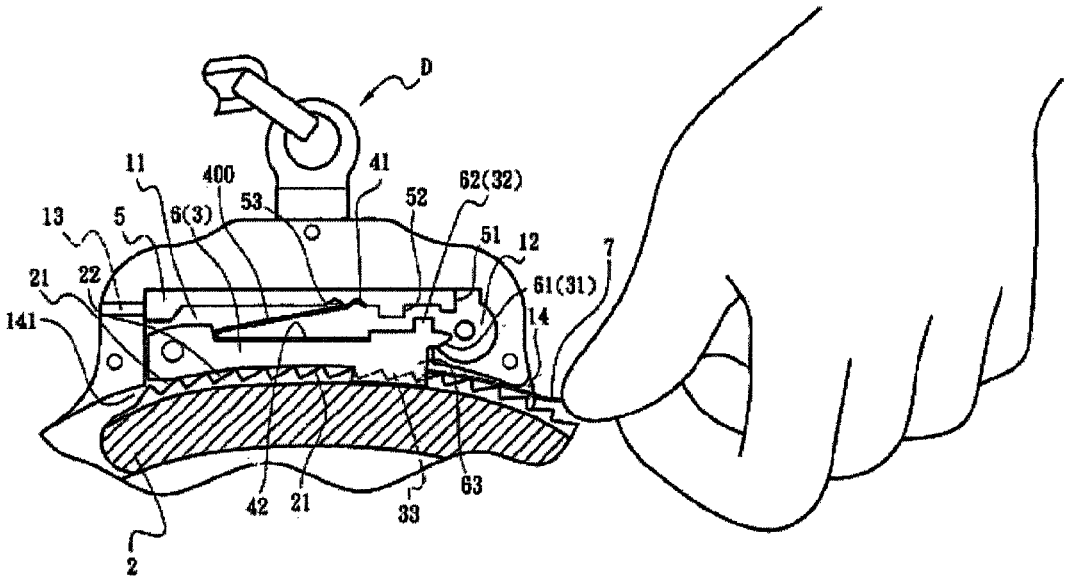
FIG. 8 is a diagram illustrating the state when somebody tries to unlock the handcuffs of the present invention by an improper means.

As shown in FIGS. 6-8, in practical application, when the free end of the movable ring hook 2 is inserted into the open side of accommodation chamber 11, the projecting teeth 21 can be engaged with the lock projecting teeth 33, 303 of locking members 3, 30 at the same time to lock the handcuffs. The stop projecting part 63 of spacer 6 can also stick into the middle channel 22 of movable ring hook 2 (there will be no interference between them since the extending direction of middle channel 22 is the same as the extending/contracting direction of movable ring hook 2). At that time, said two fixed ring hooks 1, 10 and movable ring hook 20 can define a locked space. If somebody tries to stick a narrow body 7 into the spaces 14, 141 between movable ring hook 2 and the front, rear sides of accommodation chamber 11, said narrow body 7 will be blocked by stop projecting part 63 and cannot be inserted into the space. Therefore, a narrow body 7 cannot be used to disengage lock projecting teeth 33, 303 from the plurality of projecting teeth 21. In this way, it is possible to fully solve the problem of the conventional handcuffs, that is, narrow body 7 can be easily inserted between lock projecting teeth 33, 303 and the plurality of projecting teeth 21 in order to disengage them from each other. The present design can also effectively prevent illegal unlocking by inserting a thin wire with a hook into key hole 121.

According to the present design, a thin push rod can penetrate from outside through side hole 13 to push two stop blocks 5, 50 and make them slide at the same time. The abutting parts 52, 502 of stop blocks 5, 50 can move to the right to the positions where they abut against the top projecting parts 32, 302 of locking members 3, 30 so that locking members 3, 30 form a reinforced locking state that is more difficult to unlock by illegal means. To unlock the handcuffs by normal means, the key is inserted into key recessed part 12 from key hole 121 and is first turned counterclockwise so that the projecting part at the end of the key can push the side edges 51, 501 of two stop blocks 5, 50 at the same time to make them move in the opposite direction (to the left). At that time, the two abutting parts 52, 502 are released from the abutting state against top projecting parts 32, 302. Then, the key is turned clockwise to make the projecting part push the side projecting parts 31, 301 of locking members 3, 30 and the side projecting part 61 of spacer 6 upwards at the same time. As a result, locking members 3, 30 pivot synchronously with spacer 6, and lock projecting teeth 33, 303 and stop projecting part 63 are also disengaged from the projecting teeth 21, middle channel 22 of movable ring hook 2 so that movable ring hook 2 can pivot in the opposite direction. The free end of the movable ring hook is disengaged in accommodation chamber 11 to release said locking state.

As described above, the structural modification to handcuffs disclosed in the present design can indeed increase the difficulty of unlocking the handcuffs by improper means and can improve the locking effect. It truly possesses industrial applicability, novelty, and inventiveness.

The example described above is only one preferable example of the present invention and should not limit the embodiment scope of the present invention. In other words, any equivalent variation and alteration made within the scope of the claims of the present invention is covered by the patent scope of the present claims and their equivalents.

What is claimed is:

1. Handcuffs, each handcuff comprising:

two fixed, arc-shaped hooks, the two fixed arc-shaped hooks being engaged with each other at one end to define an accommodation chamber therebetween that is open toward an inside of each fixed arc-shaped hook, and a pivoting end of the two arc-shaped hooks disposed away from the end defining the accommodation chamber, and further having a key hole disposed in one of the two fixed arc-shaped hooks and being open to at least one outer surface of one of the arc shaped hooks, the key hole being disposed at one side of the accommodation chamber of the fixed, arc-shaped hooks so as to provide access into the accommodation chamber from the outer surface;

a movable, arc-shaped hook with one pivoting end disposed away from the accommodation chamber, the pivoting end of the movable hook being connected to the pivoting end of the fixed arc-shaped hooks and the movable, arc-shaped hook being pivoted between the two fixed arc-shaped hooks at the pivoting end of the two fixed arc-shaped hooks, and further having a plurality of projecting teeth and a middle channel penetrating through each projecting tooth are provided on the outer periphery at the other end of the movable arc-shaped hook disposed away from the pivoting end of the movable arc-shaped hook, and the plurality of projecting teeth being capable of penetrating into the accommodation chamber as the movable arc-shaped hook pivots about the pivoting ends;

a plurality of identical locking members provided in parallel with each other, one end of each locking member being jointly pivoted inside the accommodation chamber, each locking member having a top side and a bottom side, and at the other end adjacent the key hole having a side projecting part projecting outwards in a direction away from the pivoted end of the locking members and adjacent the key hole, and further having a plurality of lock projecting teeth on the bottom side of each locking member, the lock projecting teeth on the bottom side of each locking member facing an open side of the accommodation chamber and being oriented to engage the projecting teeth of the movable arc-shaped hook;

at least one spacer provided between the plural locking members, with one end of the spacer being jointly pivoted together with the locking members in the accommodation chamber, a stop projecting part of the spacer corresponding to and cooperating with the lock projecting teeth of the locking members being provided at the other end of the spacer; and at least one elastic member provided adjacent to and in contact with each locking member on the top side and within the accommodation chamber so as to bias the lock projecting teeth of the locking members toward the plurality of projecting teeth of the movable, arc-shaped hook when the movable, arc-shaped hook is within the accommodation chamber, the at least one elastic member abutting against the locking members so that the lock projecting teeth thereof can maintain inward elasticity in order to fit between the plurality of projecting teeth of the movable arc-shaped hook, and the spacer being inserted into the middle channel of the movable, arc-shaped hook.

2. The handcuffs according to claim 1, wherein the accommodation chamber also has a plurality of longitudinal stop blocks, each stop block having a top side and bottom side and being movable within the accommodation chamber to stop transverse movement of each locking member to immobilize the lock projecting teeth thereof, thereby producing a reinforced locking state.

3. The handcuffs according to claim 2, further comprising at least a pair of side holes communicating with the outside provided on one side of the accommodation chamber corresponding to each stop block so that a thin push rod can be inserted into the side holes from the outside to push the stop blocks and make them slide within the accommodation chamber.

4. The handcuffs according to claim 2, wherein each locking member has a top projecting part provided on the top side opposite to the side having the plurality of lock projecting teeth, each stop block has an abutting portion disposed on the side facing the locking member, whereby the abutting portion can abut against said top projecting part as the stop block moves.

5. The handcuffs according to claim 2, wherein the at least one elastic member has a V shape and has two branched edge sides, one side terminating at a first end and the other side terminating at a second end, the first end abutting against the top side of each locking member, and the second end abutting against the bottom side of each stop block.

6. The handcuffs according to claim 4, wherein the at least one elastic member has a V shape and has two branched edge sides, one side terminating at a first end and the other side terminating at a second end, the first end abutting against the top side of each locking member, and the second end abutting against the bottom side of each stop block.

7. The handcuffs according to claim 5, wherein a plurality of alignment recessed parts are provided on the bottom side of each stop block, and a bent projecting part that can fit in one of the alignment recessed parts is provided on a side of the corresponding end of the at least one elastic member.

8. The handcuffs according to claim 6, wherein a plurality of alignment recessed parts are provided on the bottom side of each stop block, and a bent projecting part that can fit in one of the alignment recessed parts is provided on a side of the corresponding end of the at least one elastic member.

9. The handcuffs according to claim 1 wherein the locking members and the at least one spacer have respective side projecting parts that project outwards in a direction away from pivoted ends of the locking and spacer members and are provided at the end corresponding to the key hole.

10. The handcuffs according to claim 4, wherein the locking members and the at least one spacer have respective side projecting parts that project outwards in a direction away from pivoted ends of the locking and spacer members and are provided at the end corresponding to the key hole.

11. The handcuffs according to claim 5, wherein the locking members and the at least one spacer have respective side projecting parts that project outwards in a direction away from pivoted ends of the locking and spacer members and are provided at the end corresponding to the key hole.

12. The handcuffs according to claim 6, wherein the locking members and the at least one spacer have respective side projecting parts that project outwards in a direction away from pivoted ends of the locking and spacer members and are provided at the end corresponding to the key hole.

13. The handcuffs according to claim 7, wherein the locking members and the at least one spacer have respective side projecting parts that project outwards in a direction away from pivoted ends of the locking and spacer members and are provided at the end corresponding to the key hole.

14. The handcuffs according to claim 8, wherein the locking members and the at least one spacer have respective side projecting parts that project outwards in a direction away from pivoted ends of the locking and spacer members and are provided at the end corresponding to the key hole.

15. The handcuffs according to claim 3, wherein each locking member has a top projecting part provided on the top side, each stop block has an abutting part on the stop block bottom side facing the locking member, and each abutting part can abut against each said top projecting part as each stop block moves.

16. The handcuffs according to claim 3 wherein the at least one elastic member has a V shape and has two branched edge sides, one side terminating at a first end and the other side terminating at a second end, the first end abutting against the top side of each locking member, and the second end abutting against the bottom side of each stop block.

17. The handcuffs according to claim 2 wherein the locking members and the at least one spacer have respective side projecting parts that project outwards in a direction away from pivoted ends of the locking and spacer members and are provided at the end corresponding to the key hole.

18. The handcuffs according to claim 3 wherein the locking members and the at least one spacer have respective side projecting parts that project outwards in a direction away from pivoted ends of the locking and spacer members and are provided at the end corresponding to the key hole.

* * * * *